United States Patent [19]

Ishida et al.

[11] Patent Number: 4,837,883

[45] Date of Patent: Jun. 13, 1989

[54] METHOD OF WASHING CLOTHES USING A WASHING MACHINE

[75] Inventors: Katsuyuki Ishida; Fumio Torita, both of Nagoya; Yoshio Kohsaka, Aichi, all of Japan

[73] Assignee: Kabushiki Kaisha Toshiba, Kawasaki, Japan

[21] Appl. No.: 606,149

[22] Filed: May 2, 1984

[30] Foreign Application Priority Data

Jun. 7, 1983 [JP] Japan ..... 58-101283

[51] Int. Cl.[4] ..... D06F 21/08; D06F 37/34

[52] U.S. Cl. ..... 8/159

[58] Field of Search ..... 8/159; 68/23 R, 23.3, 68/38, 53, 89, 136, 148, 154, 171–174

[56] References Cited

U.S. PATENT DOCUMENTS

| | | | |
|---|---|---|---|
| 1,211,129 | 1/1917 | Franklin | 68/89 |
| 2,156,541 | 5/1939 | Misenhimer et al. | 68/174 X |
| 2,575,691 | 11/1951 | Smith | 68/174 X |
| 2,986,916 | 6/1961 | Bochan | 68/28 R X |
| 3,603,118 | 9/1971 | Brucken et al. | 68/174 X |
| 4,464,914 | 8/1984 | Torita | 68/23.5 |

FOREIGN PATENT DOCUMENTS

| | | |
|---|---|---|
| 36-13469 | 8/1961 | Japan . |
| 49-33863 | 9/1974 | Japan . |
| 51-56580 | 5/1976 | Japan . |
| 55-25878 | 2/1980 | Japan . |

*Primary Examiner*—Philip R. Coe

*Attorney, Agent, or Firm*—Foley & Lardner, Schwartz, Jeffery, Schwaab, Mack, Blumenthal & Evans

[57] ABSTRACT

In a method of washing clothes by a washing machine having a washing tub including a fixed drum mounted on the upper side of the tub, and a movable drum disposed under the fixed drum so as to rotate horizontally. Small loads are washed by the water flow within the movable drum, while large loads are washed by water flow and the force of contact friction between the fixed drum and the movable drum to cause a twisting and rubbing wash action.

2 Claims, 2 Drawing Sheets

METHOD OF WASHING CLOTHES USING A WASHING MACHINE

BACKGROUND OF THE INVENTION

The invention relates to a method of washing clothes using a washing machine having a washing tub which has a fixed drum and a movable drum.

Conventional washing machines generally accomplish washing action by establishing a vortex flow within a washing tub to repeatedly agitate clothes by drawing them into the tub of the machine. In such a machine, the volume of the tub must be large with respect to the amount of clothes being washed. In the case that a small load of clothes is being washed, the vortex flow is so hard that the clothes are washed excessively. On the other hand, if a large load of clothes is put into the machine, the resulting vortex flow is too slow and insufficient to efficiently wash the clothes. Moreover, since only a portion of the clothes will accidentally contact the agitator, it is unlikely that all of the clothes will be washed thoroughly by the effect of twisting of the clothes within the washing tub. Conversely, the portion of the clothes which does contact the agitator is washed excessively, so that such articles may be damaged within the washing tub.

Recently, a new type of washing machine is available. This type of washing machine does not have an agitator but has a washing tub which is horizontally rotatable as a whole with washing liquid and clothing mixed therein for washing. The tub is intermittently rotated in forward and reverse directions to wash the clothes by means of a vortex flow produced by the difference in flow speed between the washing liquid and the articles of clothing. In this type of washing machine the clothes are not damaged. Examples of such teachings are shown in Japanese Publications Nos. 49-33863 and 51-56580 and in U.S. Pat. No. 2,986,916. Another example of a simple rotating drum is shown in Japanese Publication No. 36-13469. However, this new type of washing machine has relatively low washing power because the difference in flow speed between the clothes and the liquid stored within the washing tub is small. Accordingly, many conventional washing machines fail to provide an equivalent and homogeneous wash with varying amounts of clothes in the machine.

SUMMARY OF THE INVENTION

It is a primary object of the present invention to provide a new method of washing clothes by a washing machine.

It is another object of the invention to provide a method of washing lots of clothes at the same time in an equivalent, homogeneous manner.

It is a further object of the invention to provide a method of washing clothes without damage thereof.

To accomplish the foregoing and other objects in accordance with a preferred embodiment of the invention, there is provided a washing machine having a washing tub which includes a fixed drum mounted on the upper side of the tub and a movable drum disposed under the fixed drum so as to rotate horizontally in an alternating forward and reverse direction. In the method of washing clothes according to the invention, clothes are mainly washed by water flow within the movable drum when a small amount of clothes and washing liquid are placed in the tub, and, when there is a large load of clothes, they are washed primarily through friction between the fixed drum and the water flow.

BRIEF DESCRIPTION OF THE DRAWINGS

Features of the present invention will be apparent from the following drawings, wherein.

DETAILED DESCRIPTION OF THE PREFERRED EMBODIMENT

Figure 1:
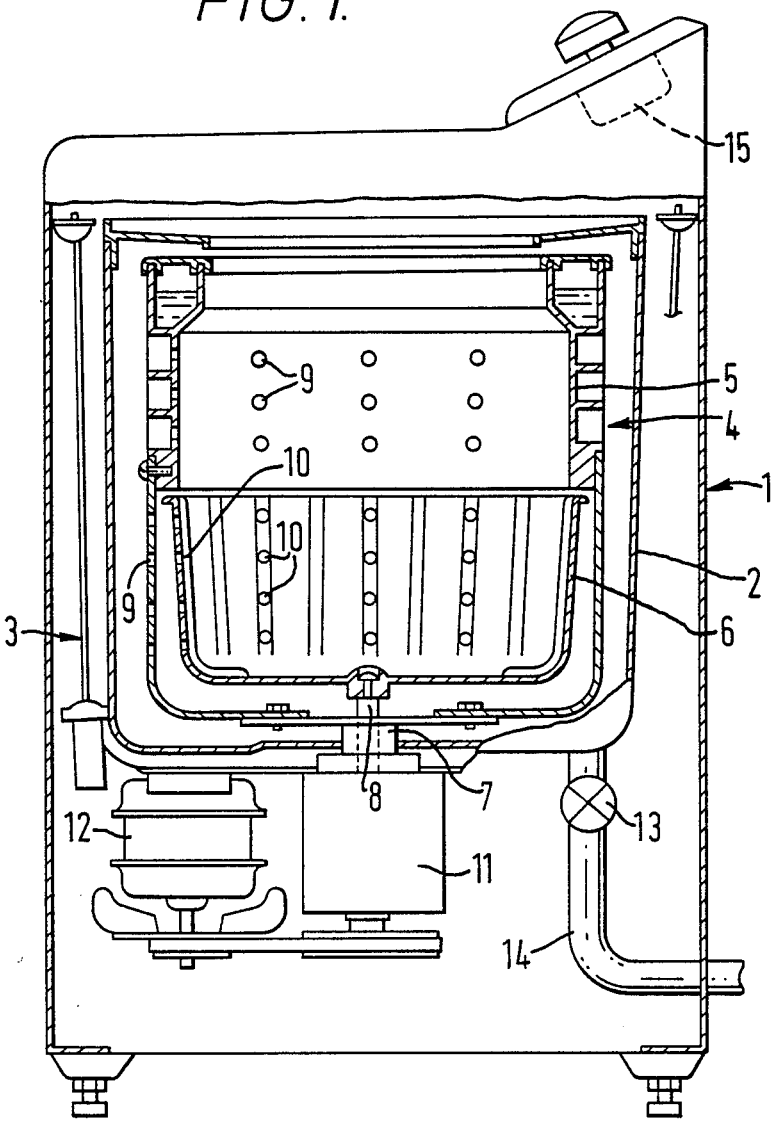
FIG. 1 is a vertical section view showing a washing machine operable in accordance with method of the present invention.

Referring now more specifically to the drawings, a preferred embodiment of a washing machine to perform the method of the present invention is shown in FIG. 1.

Housing 1 includes a water-receiving tub 2 suspended by an elastic suspension member 3, for absorbing erratic movement of the tub 2. Water-receiving tub 2 is itself fixedly mounted with respect to washing tub 4 which, in the embodiment of the washing machine shown, serves the dual purpose of a washing and drying tub. One should, of course, appreciate that the present invention can also be suitably utilized when the tub 4 is solely a washing tub.

The washing tub 4 is disposed in the tub 2 and is fixedly connected to rotary shaft 7 of a transmission 11 which transmits rotary movement in a predetermined manner. The washing tub 4 includes a fixed drum 5 and a movable drum 6. The fixed drum 5 is fixedly mounted on the upper side of the washing tub 4. The movable drum 6 is disposed under the drum 5 as a basket and is fixedly connected to rotary shaft 8. In the preferred embodiment in which the machine has both a washing and drying operation, the washing tub 4 and fixed drum 5 have spaced openings 9, and the movable drum 6 has spaced openings 10 at the periphery thereof. Fixed drum 5 is rotated with movable drum 6 through the shafts 7 and 8 during the drying cycles, but is stationary during the washing cycles wherein movable drum 6 is rotated through shaft 8 which is disposed within shaft 7. The diameter of movable drum 6 is almost the same as drum 5. The inner wall of drum 6 is rugged, and it has a depth of about half of the washing tub 4. The movable drum 6 is horizontally rotated through transmission 11 by the power of driving motor 12 during the washing cycles.

The transmission 11 includes a reduction mechanism, a clutch, and a brake mechanism (not shown) for selectively transmitting the rotary motion provided by driving motor 12 to the rotary shafts 7 and 8 in such as manner that, during washing cycles, the movable drum 6 is independently rotated with the drum 5 fixed, while during drying cycles both the washing tub 4 and the movable drum 6 are rotated as a unit. Moreover, in the washing cycle, the movable drum 6 is rotated in forward and reverse directions in successively repeated cycles. For example, the drum 6 can rotate through three revolutions in the forward direction followed by rotation through three revolutions in the reverse direction. This cycle of operation is successively repeated so as to induce agitation of the washing liquid in the tub 4. When drain valve 13 is opened, washing liquid in the tub 4 is discharged through drain hose 14 from the bottom of water-receiving tub 2. Timer mechanism 15 automatically controls the process of washing and drying cycles. The foregoing apparatus is more particularly described in the commonly assigned application by the same inventors entitled "Washing Machine" filed concurrently herewith, Ser. No. 606,265.

The washing machine according to this invention operates in the following manner. In the washing operation, at first, washing liquid is poured into the washing tub 4 together with clothes to be washed. The movable drum 6 is rotated by motor 12 through transmission 11, while fixed drum 5 is prevented from rotating by means of the brake mechanisms in transmission 11. The movable drum 6 is rotated at about 120 to 180 revolutions per minute, and is turned so as to alternate in rotational directions every second or third revolution. In such a manner, clothes contact with both movable drum 6 and fixed drum 5 at numerous portions of the washing tub 4. Clothes positioned toward the center of movable drum 6 are swung by the force of friction in contact with other clothes similarly situated and with the wall of movable drum 6. Clothes on the outer periphery of drum 6 and drum 5 are forced in the opposite direction of motion induced by movable drum 6 as a result of the frictional contact force with the wall of fixed drum 5. Accordingly, clothes are repeatedly affected by twisting and compressing actions resulting from the alternate rotation of movable drum 6. Further, fixed drum 5 and the alternating directional movement of movable drum 6 serve to counter the pure centrifugal force provided by rotation of movable drum 6, and clothes are thereby forced from the wall of fixed drum 5 toward the inside of the washing tub 4. Such action tends to turn clothes upside down in a random fashion. Thus, clothes are washed by the friction force between different articles of clothing, the twisting washing action through friction between fixed drum 5 and movable drum 6, and a kind of rubbing wash action resulting from twisting and pressing clothes repeatedly.

Figure 2:
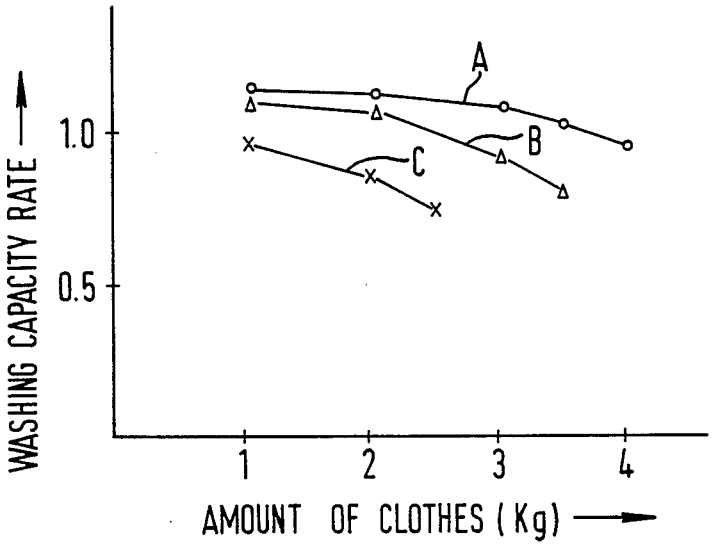
FIG. 2 is a graph showing washing power characteristics of various washing methods.

It is shown in FIG. 2 that the washing power by this method is excellent in comparison with other washing methods. FIG. 2 is a graph of experimental results shown washing power characteristics according to the amount of clothes in various washing method, namely: the method in accordance with this invention (A); the conventional method using a rotating agitator (B); and the recent method of a purely rotating washing tub as described above in the background of the invention (C).

Moreover, since clothes are washed as a result of contact friction between fixed drum 5 and movable drum 6, the friction force grows larger as the amount of clothes increases. Therefore, even a large load of clothes is washed in an efficient and effective manner.

Further, when washing a small load, the clothes are mainly washed as a result of water flow within movable drum 6. With a small load, the clothes do not come in frequent contact with the wall of movable drum 6 so that the contact frictional force is very small. Accordingly, as the water flow is not as vigorous as with a conventional agitator type washing machine, the clothes are effectively washed without damage regardless of the amount of clothes. Thus, the range of the amount of clothes which may be suitably washed is larger than in conventional washing method, as shown in FIG. 2.

In the preferred embodiment, the drying operation is effected by rotating the washing tub 4 in one direction according to the clutch mechanism (not shown) in the transmission 11 after drainage of the washing liquid by means of opening drain valve 13.

Finally, according to the method of the invention, the washing machine has the washing tub, including the fixed drum mounted on the upper side, and movable drum disposed under the fixed drum so that small loads of clothes are mainly washed by water flow within the movable drum, and large loads are washed by water flow and contact friction between the fixed and movable drums.

While the invention has been described in reference to preferred embodiments, it will be understood by those skilled in the art that various modifications may be made without departing from the spirit and scope of the invention as set forth in the appended claims.

What is claimed is:

1. A method of washing clothes comprising the steps of:

(a) disposing said clothes and a washing liquid in a washing tub having an upper and lower drum, (b) rotating said lower drum containing said clothes in alternating directions to thereby cause water flow agitation of said clothes, said rotating steps including rotating said lower drum about 120–180 revolutions per minute and periodically changing the direction of rotation of said lower drum about every two to three rotations, (c) simultaneously with said rotating step, retaining said upper drum stationary, and (d) simultaneously with said rotating step, agitating said clothes to thereby cause frictional contact of clothes contacting said upper and lower drums.

2. A method of washing clothes comprising the steps of:

(a) agitating said clothes by water flow provided by rotating a drum containing said clothes at a rotational speed of about 120–180 revolutions per minute in alternating directions of rotation, (b) changing the direction of rotation about every two to three revolutions whereby a relatively small load of clothes may be washed, and (c) agitating said clothes by frictional contact of said clothes with a stationary drum positioned above said rotating drum whereby a relatively large load of clothes may be washed.

* * * * *